United States Patent [19]

Marschak

[11] Patent Number: 4,491,226

[45] Date of Patent: Jan. 1, 1985

[54] DISPLAY SHELF

[76] Inventor: Howard J. Marschak, 865 W. North Ave., Chicago, Ill. 60622

[21] Appl. No.: 386,889

[22] Filed: Jun. 10, 1982

[51] Int. Cl.[3] ..... A47F 5/00

[52] U.S. Cl. ..... 211/186; 108/111; 211/135; 211/153

[58] Field of Search ..... 211/186, 187, 135, 191, 211/190, 175, 153; 248/243; 108/111

[56] References Cited

U.S. PATENT DOCUMENTS

| | | | |
|---|---|---|---|
| 3,398,981 | 8/1968 | Vincens | 211/186 X |
| 3,693,556 | 9/1972 | Rous | 211/135 X |
| 4,145,849 | 3/1979 | Shindoll et al. | 108/111 X |

FOREIGN PATENT DOCUMENTS

| | | | |
|---|---|---|---|
| 6403806 | 10/1965 | Netherlands | 211/191 |
| 205195 | 6/1966 | Sweden | 211/187 |

*Primary Examiner*—Robert W. Gibson, Jr.
*Attorney, Agent, or Firm*—Emrich & Dithmar

[57] ABSTRACT

A display stand having two pair of uprights with each upright having an inwardly facing flat face portion. Horizontal beams connect each pair of uprights with each beam having an upstanding tab extending from near each end thereof defining a space between the tab and the adjacent flat face of the associated upright. A display shelf has integral mounting means extending perpendicularly from the shelf in registry with each upright and having an arcuate lip portion adjacent each upright with a slot therein. There is a slot in the shelf in vertical alignment with each slot in the mounting means, and each slot is sized snugly to receive the associated upstanding tab on said horizontal beams. Also disclosed is an extension shelf slideable with respect to the main shelf with detent latching means preventing disengagement of the shelf extension.

11 Claims, 11 Drawing Figures

FIG. 6
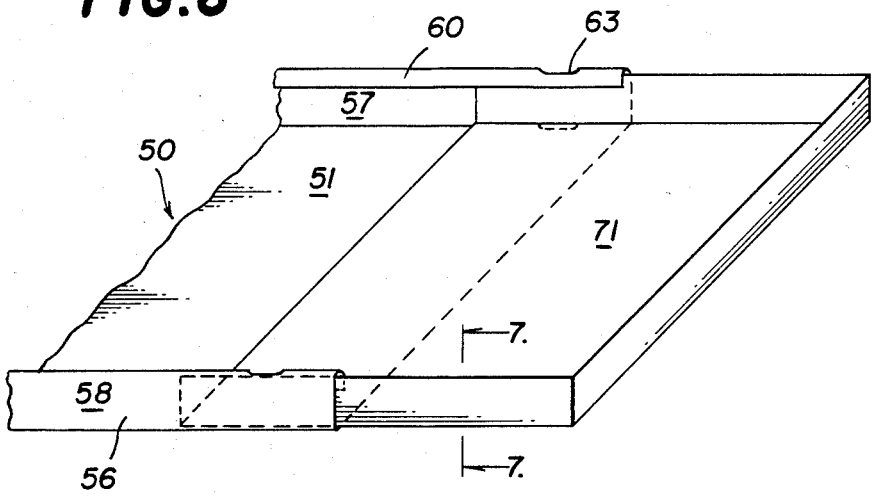
FIG. 7
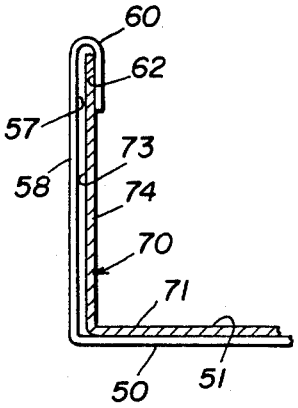
FIG. 8
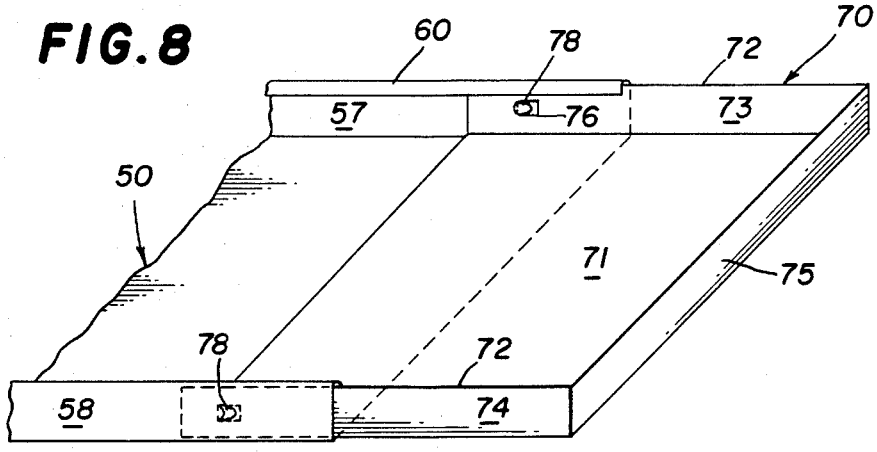
FIG. 10
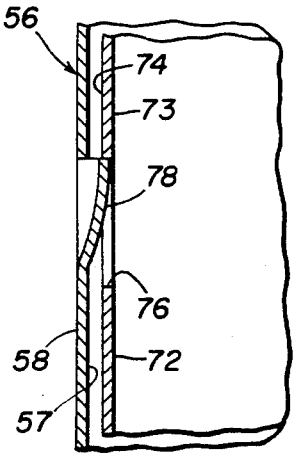
FIG. 9
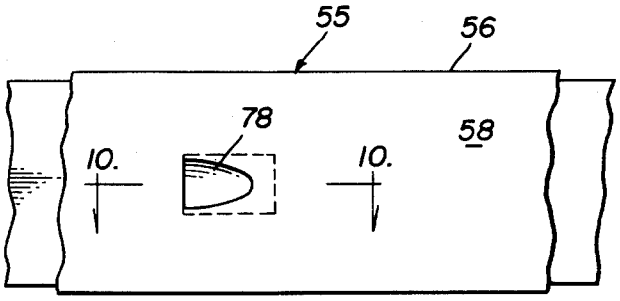
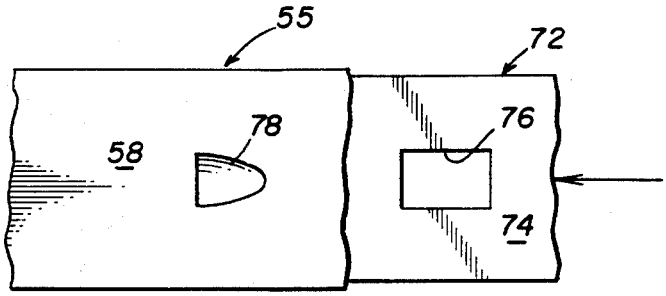
FIG. 11

DISPLAY SHELF

BACKGROUND OF THE INVENTION

This invention relates to a display and more particularly to an easily constructed yet sturdy display stand for a point-of-sale merchandising.

Point-of-sale display devices are numerous and involve several well known problems. First the stand must be easily constructed yet sturdy, due to the abuse to which these devices are subjected. Next, the stand must have adequate display area, and the display device or stand should be adjustable to permit or accommodate display of items of various sizes.

The display device of the subject invention solves all of the above enumerated problems by providing a stand which is easy to construct yet very sturdy. Additionally, each shelf may be provided with an extension as as greatly to increase the display area.

SUMMARY OF THE INVENTION

This invention relates to a display stand with improved sturdiness and expandable display area.

A principal object of the present invention is to provide a display comprising at least two uprights each having an inwardly facing flat face portion, a horizontal beam mounted between each pair of uprights extending generally perpendicularly between the flat face portions of the uprights, an upstanding tab extending from near each end of the horizontal beam adjacent and parallel to each flat face portion defining a space therebetween when the beam is mounted on the uprights, a display shelf having a substantially flat support surface having a dimension at least as great as the distance between the upstanding tabs, mounting means extending perpendicularly from the support surface in registry with each upright and having an arcuate lip portion with a slot therein, a pair of slots in the shelf with each slot being aligned with a respective slot in the mounting means, the slots being sized snugly to receive the associated upstanding tab on the horizontal beam, whereby the display shelf is mounted on the uprights and the beam by inserting each tab through an associated pair of slots to provide vertically spaced apart connections between each of the tabs and the mounting means with the mounting means being positioned in the space between each of the tabs and the adjacent upright while the beam provides support for the shelf.

Yet another object of the present invention is to provide a display of the type set forth comprising a pair of uprights with each upright having an inwardly facing flat face portion, a horizontal beam connecting each pair of uprights with each bean extending generally perpendicularly between the flat face portions of the associated uprights, an upstanding tab extending from near each end of each horizontal beam defining a space between the tab and the adjacent flat faced of the associated upright, a display shelf having a substantially flat support surface, mounting means extending perpendicularly from the support surface in registry with each upright and having an arcuate lip portion with a slot therein, a plurality of slots in the shelf with each slot being aligned with a respective slot in the mounting means, each slot being sized snugly to receive the associated upstanding tab on the horizontal beams, whereby the display shelf is mounted on the uprights and the beams by inserting the tabs through an associated pair of slots to provide vertically spaced apart connections between the tabs and the mounting means with the mounting means being positioned in the space between the tabs and the adjacent uprights while the beams provide support for the shelf.

Yet another object of the present invention is to provide a display of the type set forth wherein there is provided a shelf extension nestably mounted in the display shelf having upstanding sides slideable with respect to the display shelf mounting means between a storage position wherein the shelf extension is fully nested and an extended position wherein the shelf extension extends beyond the display shelf to provide additional display area.

These and other objects of the present invention may be more readily understood by reference to the accompanying specification and drawings in which:

BRIEF DESCRIPTION OF THE DRAWINGS

FIG. 6 is a perspective view of a display shelf and shelf extension in nested condition wherein the shelf extension is in the extended position thereof;

FIG. 7 is a view in section of the display shelf and shelf extension illustrated in FIG. 6 as seen along line 7—7 thereof;

FIG. 8 is a view of a display shelf and shelf extension as in FIG. 6 with a detent locking mechanism added to prevent inadvertent removal of the shelf extension from the display shelf;

FIG. 9 is an enlarged view of the detent and locking mechanism illustrated in FIG. 8;

FIG. 10 is a view in section of the detent and locking mechanism illustrated in FIG. 9 as seen along line 10—10 thereof; and FIG. 11 is a view of the detent and locking mechanism illustrated in FIG. 10 in the unlocked position thereof.

DESCRIPTION OF THE PREFERRED EMBODIMENTS

Figure 1:
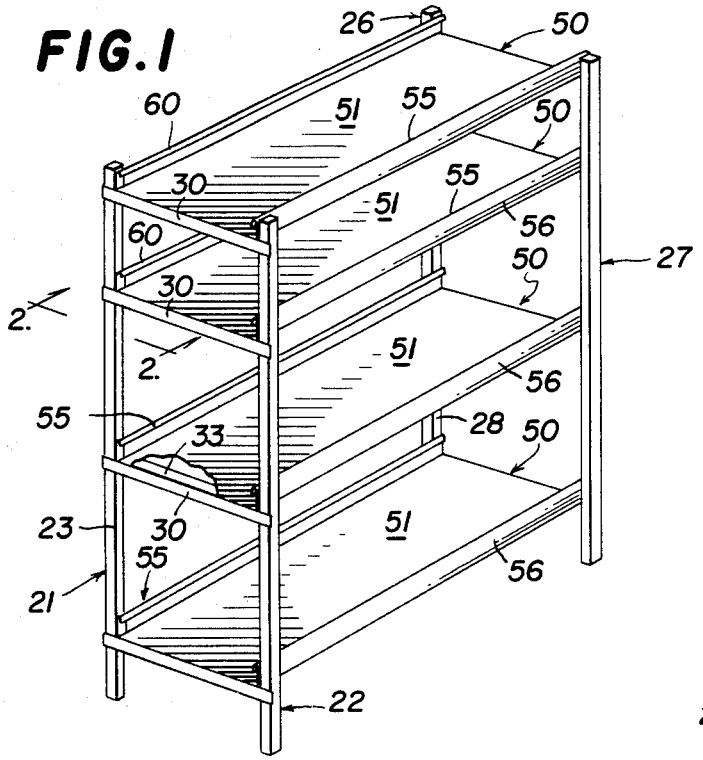
FIG. 1 is a perspective view of the display of the present invention.

Referring now to FIG. 1 there is shown a display stand 20 of the present invention including a pair of uprights 21 and 22 transversely spaced apart each provided with an inwardly facing flat surface 23 and a pair of uprights 26 and 27 transversely spaced apart the same distance as the front uprights 21, 22 and longitudinally disposed with respect thereto. Each of the uprights 26, 27 have inwardly facing flat surfaces 28. As illustrated, there are a plurality of horizontally disposed shelves 50, only one of which will be described for brevity. Each shelf 50 rests on a pair of horizontal beams 30, each of the beams supporting each shelf 50. Each of the horizontal beams 30 is generally U-shaped in transverse cross section and has a front panel 31 and a rear panel 32 joined at the top by a panel 33. At each end of the beams 30 there are extensions 35 of the front and rear panels 31, 32 with each extension 35 being provided with a pair of vertically spaced longitudinally extending slots 36 dimensioned to receive a fastening means such as a fillet weld 37 thereby to fasten each of the beams 30 to the respective upright pairs 21, 22 and 26, 27.

Figure 2:
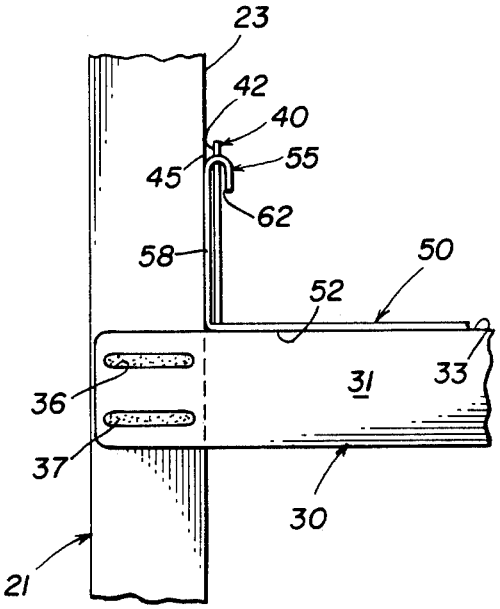
FIG. 2 is an enlarged view of the shelf mounting means and connecting apparatus between the uprights and the shelf illustrated in FIG. 1.

Each of the horizontal beams 30 has an upstanding tab 40 generally formed from the top panel 33 and extending generally perpendicularly to the top panel 33 positioned near the inwardly facing flat surface 23 of the rear pair of uprights 21, 22 and similarly parallel to and spaced a short distance from the integrally facing flat surface 28 of the far pair of uprights 26, 27, see FIG. 1. Each of the upstanding tabs 40 has side edges 41 and a flat outer surface 42 which as before mentioned is parallel to and slightly spaced from the associated inwardly facing flat surfaces 23, 28 thereby to define a space 45 therebetween, see FIG. 2.

Each shelf 50 has an upper surface 51 and a bottom surface 52 and is provided with four slots 53 adjacent each corner. Each of the slots 53 extends transversely with respect to the display stand 20 and has a transverse extent substantially equal to the transverse extent of the upstanding tab 40 thereby to cause the side edgers 41 of each tab to contact the ends of the corresponding slot 53 when the tab 40 is inserted thereinto.

Integral with each of the shelves 50 extending generally perpendicular to the upper surface 51 thereof is a mounting means 55 at each end edge of the shelf extending transversely of the shelf. Accordingly, each shelf 50 is provided with two mounting means 55 to cooperate with each pair of near and far uprights 21, 22 and 26, 27. Each of the mounting means 55 is provided with an upstanding portion 56 having an inner surface 57 and an outer surface 58. The mounting means 55 has integral with the upstanding portion 56 a lip portion 60 with a downturned end 61 extending inwardly of the upstanding portion 56. The downturned end 61 of the lip portion 60 has an inner surface 62 and a transversely extending slot 63 in vertical registry with the associated slot 53 in the upper surface 51 of the shelf 50. The transverse dimension of the slot 63 is the same as the slot 53 and is in vertical registry therewith thereby to provide vertically spaced contacts for the mounting means 55 and the shelf 50 with respect to the upstanding tab 40 when the tab is inserted into the shelf.

Figure 3:
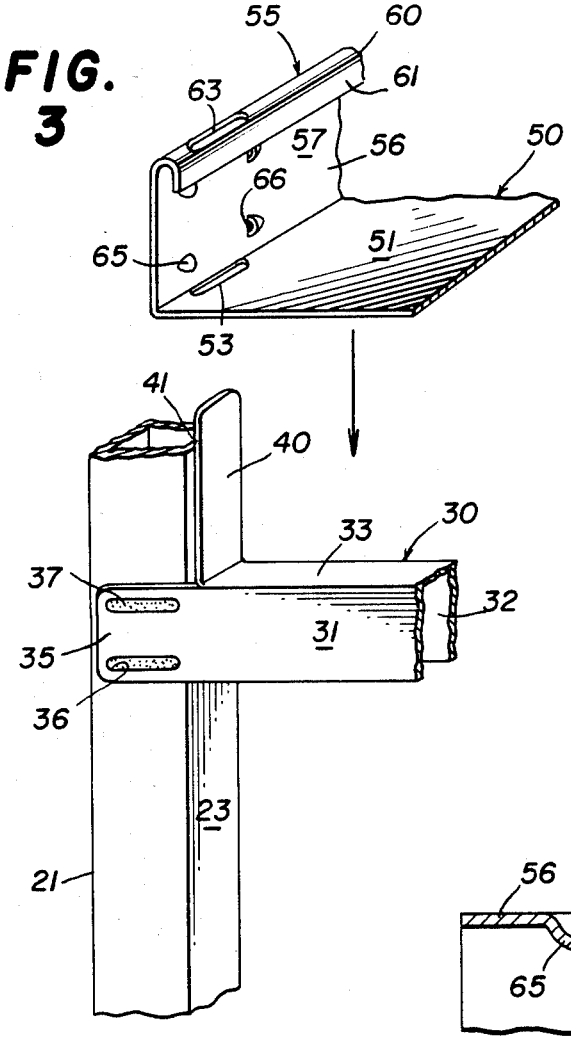
FIG. 3 is an enlarged exploded perspective view of the display shelf mounting means, horizontal beam with upstanding tabs and upright illustrated in FIG. 2.
Figure 4:
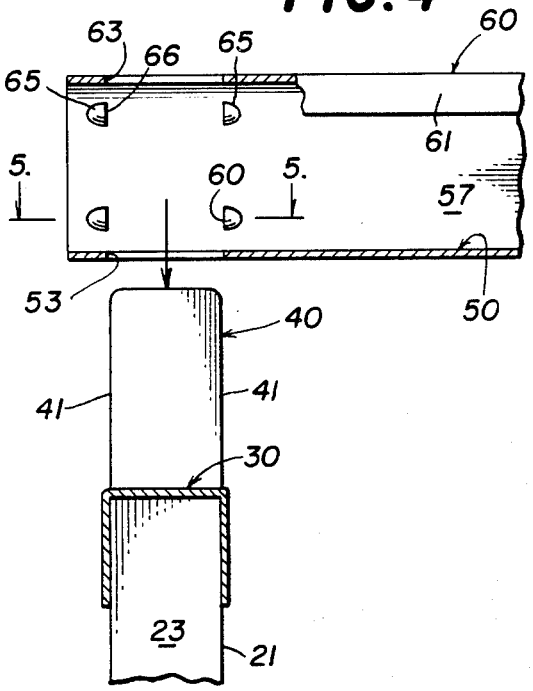
FIG. 4 is a right-hand elevational view partly in section of the exploded parts illustrated in FIG. 3.
Figure 5:
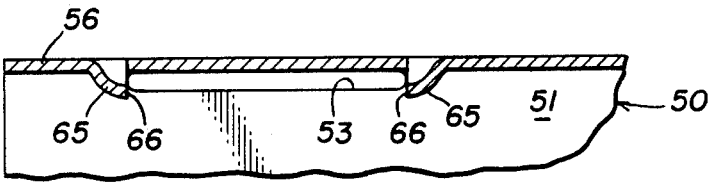
FIG. 5 is a sectional view of the display illustrated in FIG. 4 as seen along line 5—5 thereof.

On the mounting means 55 and particularly on the inner surface 57 of the upstanding portion 56 are punched out contacts 65 extending inwardly of the inner surface 57, each having a bearing surface 66. As illustrated in FIGS. 3, 4 and 5 there are four contacts 65 associated with each slot 63 in the mounting means 55 with the bearing surfaces 66 of each set of four punched out contacts 65 being positioned to contact the side edges 41 of the upstanding tab 40 when it is inserted through the vertically spaced and aligned slots 53, 63.

As may be seen therefore, the two pair of uprights consisting of the near uprights 21, 22 and the far uprights 26, 27 are held together in rigid condition by the horizontal beams 30 cooperating with the mounting mechanism or mounting means 55 on the shelves to hold the display 20 in rigid condition. The entire display stand 20 is a very firm construction due to the cooperation between the mounting means 55 of each shelf 50 from the two horizontal beams 30 provided for each shelf.

Further, the vertically spaced aparts 53, 63, of which four pairs are provided for each shelf, provide extreme rigidity to the display stand 20 so that the normal abuse to which these stands are subjected during point-of-purchase display does not result in a loosening of the structure and perhaps damage to the displayed merchandise. Because of the unique shelf construction 50 no additional supports are required between the pair of near uprights 21, 22 and the pair of far uprights 26, 27 thereby decreasing the cost of the display stand and simplifying the construction thereof.

While the display stand 20 is entirely sufficient to achieve all the objects of the present invention, it is also desired to provide additional display area. To that extent, there is provide a shelf extension 70, see FIGS. 6–11, which may be associated with any one or more of the shelves 50, the only proviso being that too much weight outside the two pair of uprights 21, 22 and 26, 27 could provide an unstable condition. In any event, the shelf extension 70 includes a flat upper surface 71 for receiving merchandise and upstanding sides 72 each provided with an inner facing surface 73 and an outer facing surface 74. A front guard rail 75 is provided integral with the sides 72 to ensure that merchandise displayed on the shelf extension 70 does not fall out. In one embodiment of the invention, a detent 78 is punched out of the upstanding portion 56 of the mounting means 55. The detent 78 extends inwardly of the inner surface 57 and is appropriately dimensioned to fit within a cut-out 76 in the side panel 72 of the shelf extension 70.

When the shelf extension is in the fully extended position as illustrated in FIG. 8, then the detent 78 will rest in the cut-out 76, as best seen in FIG. 10, and contact the rear vertically extending edge of the cut-out 76, thereby preventing further outward movement of the extension 70. Inward movement of the shelf 70 to its storage position is facilitated by the tapered shape of the detent 78 which provides a camming action for the shelf extension 70 as it is moved rearwardly with respect to the shelf 50.

As seen particularly in FIG. 7, the shelf extension 70 is dimensioned such that the inner surface 74 of each side 72 thereof abuts and contacts the inner surface 62 of the associated lip 60 of the mounting means 55, thereby to provide sufficient room both for the detent 78 and for the upstanding tabs 40, as previously described.

While there has been described what at present is considered to be the preferred embodiment of the present invention, it will be understood by those skilled in the art that various modifications and alterations may be made therein without departing from the true spirit and scope of this invention, the limits of which are defined by the claims appended hereto.

What is claimed is:

1. A display comprising at least two uprights each having an inwardly facing flat face portion, a horizontal beam mounted between the pair of uprights extending generally perpendicularly between the flat face portions of said uprights, an upstanding tab extending from near each end of said horizontal beam adjacent and parallel to each flat face portion defining a space therebetween when said beam is mounted to said uprights, a display shelf having a substantially flat support surface having a dimension at least as great as the distance between said upstanding tabs, a pair of mounting means extending perpendicularly from said support surface in registry with each upright and each mounting means having an arcuate lip portion with a slot therein, a pair of slots in said shelf with each slot being aligned with a respective slot in said mounting means, said slots being sized snugly to receive the associated upstanding tab on said horizontal beam, whereby said display shelf is mounted on said uprights and said beam by inserting each tab through an associated pair of slots to provide vertically spaced apart connections between each of said tabs and said mounting means being positioned in the space between each of said tabs and the adjacent upright while said beam provides support for said shelf.

2. The display of claim 1, and further comprising a pair of contacts mounted on said mounting means opposite each of said slots for contacting said upstanding tab when it is inserted through said pair of vertically aligned slots to provide additional contact between said mounting means and said upstanding tab.

3. The display of claim 1, wherein said horizontal beam is generally U-shaped in transverse cross section with opposed end portions extending beyond said adjacent tab removably mounted to opposite sides of the associated upright.

4. The display of claim 1, and further comprising an extension shelf nestably mounted inside said display shelf and movable with respect thereto from a storage position to a fully extended position, said shelf extension in the fully extended position extending beyond said display shelf providing additional display area.

5. The display of claim 4, wherein one of said display shelf mounting means and said shelf extension has a detent and the other has an opening therein for receiving said detent such that when said shelf expansion is in the fully extended position thereof said detent is received in said opening to prevent said shelf extension from further movement with respect to said display shelf.

6. The display of claim 4, wherein said shelf extension has upstanding sides and end panels, said sides disposed in said mounting means and nested therein for sliding movement with respect thereto between the storage and extension positions thereof.

7. A display comprising two pair of uprights with each upright having an inwardly facing flat face portion, a horizontal beam connecting each pair of said uprights with each beam extending generally perpendicularly between the flat face portions of the associated uprights, an upstanding tab extending from near each end of each horizontal beam defining a space between said tab and the adjacent flat face of said associated upright, a display shelf having a substantially flat support surface, mounting means extending perpendicularly from said support surface in registry with each upright and having an arcuate lip portion with slots therein, slots in said shelf with each slot being aligned with a respective slot in said mounting means, each slot being sized snugly to receive the associated upstanding tab on said horizontal beams, whereby said display shelf is mounted on said uprights and said beams by inserting said tabs through an associated pair of slots to provide vertically spaced apart connections between said tabs and said mounting means with said mounting means being positioned in the space between said tabs and the adjacent uprights while said beams provide support for the shelf.

8. The display of claim 7, and further comprising contacts on said mounting means on opposite sides of said slot to provide additional contact between said upstanding tab and said mounting means.

9. The display of claim 7, wherein said horizontal beam is generally U-shaped in transverse cross section and has opposite sides thereof extending beyond each upstanding tab to provide means for mounting the horizontal beam to said uprights, each of said opposite sides having vertically displaced longitudinally extending slots therein for receiving fastening means therethrough.

10. The display of claim 7, and further comprising a shelf extension nestably mounted in said display shelf having upstanding side panels disposed in said display shelf mounting means and slideable with respect thereto.

11. The display of claim 10, and further comprising a detent on one of said display shelf mounting means and said shelf extension mounting means and an opening in the other of said display shelf mounting means and said shelf extending mounting means such that when said shelf extension is in the fully extended position thereof said detent is in said opening thereby preventing further sliding movement of said shelf extension with respect to said display shelf.

* * * * *